US007578235B2

(12) United States Patent
Metrope

(10) Patent No.: US 7,578,235 B2
(45) Date of Patent: Aug. 25, 2009

(54) PRINT UNIT HAVING CYLINDERS FORMING A COUNTERWEIGHT AND CORRESPONDING PRESS

(75) Inventor: Jacques Metrope, Laigneville (FR)

(73) Assignee: Goss International Montataire SA, Montataire (FR)

( * ) Notice: Subject to any disclaimer, the term of this patent is extended or adjusted under 35 U.S.C. 154(b) by 253 days.

(21) Appl. No.: 11/501,294

(22) Filed: Aug. 9, 2006

(65) Prior Publication Data

US 2007/0039493 A1 Feb. 22, 2007

(30) Foreign Application Priority Data

Aug. 16, 2005 (FR) ..... 05 08557

(51) Int. Cl.
*B41F 13/24* (2006.01)
*B41F 13/34* (2006.01)

(52) U.S. Cl. ..... 101/218; 101/216; 101/247

(58) Field of Classification Search ..... 101/181, 101/187, 216, 218, 247, 375
See application file for complete search history.

(56) References Cited

U.S. PATENT DOCUMENTS 3,527,165 A * 9/1970 Harless ..... 101/143
5,791,246 A 8/1998 Kelm ..... 101/218
6,216,592 B1 4/2001 Knauer et al. ..... 101/247
6,227,111 B1 5/2001 Dawley et al. ..... 101/218
2004/0177778 A1 9/2004 Christel et al. ..... 101/216
2006/0225590 A1 * 10/2006 Dawley et al. ..... 101/217

FOREIGN PATENT DOCUMENTS

DE 91 09 833.5 U1 9/1991
DE 91 09 833.5 U1 10/1991
FR 2 787 059 6/2000
FR 2 792 871 11/2000

* cited by examiner

*Primary Examiner*—Daniel J Colilla
(74) *Attorney, Agent, or Firm*—Davidson, Davidson & Kappel, LLC

(57) ABSTRACT

The invention provides a unit for printing a web of paper including a frame and at least a first and a second printing group, each printing group including a blanket cylinder and a plate cylinder, the printing unit also including a throw off mechanism for supporting and moving the cylinders, into at least one throw-on configuration, in which the blanket cylinders are pressed against each other and against the plate cylinders, and a throw-off configuration, in which the blanket cylinders are spaced apart from each other and from the plate cylinders. The throw-off mechanism includes at least a first system for returning the mass of at least a first cylinder of the first printing group towards a first cylinder of the second printing group and vice-versa so that the first cylinders form mutual counterweights when the printing unit moves between the throw-on and throw-off configurations thereof.

11 Claims, 3 Drawing Sheets

PRINT UNIT HAVING CYLINDERS FORMING A COUNTERWEIGHT AND CORRESPONDING PRESS

BACKGROUND

The present invention relates to a unit for printing a web of paper comprising a frame and at least a first and a second printing group, each printing group comprising a blanket cylinder and a plate cylinder, the printing unit also comprising a mechanism for supporting and moving the cylinders, by means of which mechanism the printing unit has at least one throw-on configuration, in which the blanket cylinders are pressed against each other and against the plate cylinders, and a throw-off configuration, in which the blanket cylinders are spaced apart from each other and from the plate cylinders.

The invention is used in particular for offset presses, for example, for printing books.

The throw-off configuration allows, for example, the blankets of the blanket cylinders to be changed.

The throw-on configuration allows the printing unit to print the web of paper which passes between the blanket cylinders.

In addition to these two configurations, the unit generally has an intermediate configuration between the throw-off and throw-on configurations. In this configuration, which in particular allows plates to be changed, the blanket cylinder of each printing group is pressed against the plate cylinder of the same group but remains spaced apart from the blanket cylinder of the other printing group.

The throw-off configuration and the plate-changing configuration allow the web of paper to pass between the blanket cylinders of the two printing assemblies and thus to pass through the printing unit which is in the idle state. The web of paper can at the same time continue to be printed by other printing units.

This allows a printing operation to be carried out by some units within the same printing press whilst other units in the idle state are prepared for the following printing operation.

A press of this type is generally referred to as an "Auto Transfer" press.

FR-2-787 059 describes a printing unit of the above-mentioned type wherein the web of paper moves horizontally. The first printing group is thus arranged above the web of paper and the second printing group below. The support mechanism comprises arms which are articulated to the frame and on which the cylinders of the two assemblies pivot. The movement from the throw-on configuration to the throw-off configuration is carried out by raising the upper arms and therefore the cylinders of the upper printing group and by lowering the lower arms and therefore the cylinders of the lower printing group. Conversely, the movement from the throw-off configuration to the throw-on configuration is carried out by lowering the upper arms and cylinders and by raising the lower arms and cylinders.

During the lowering movements, the cylinders are driven by their own weight in such a manner that their movements would normally be limited by stops.

Although a kinematic system of this type is acceptable for cylinders having small dimensions which are, for example, intended to print 8 or 12 tabloid pages per printing group, it is unsuitable for cylinders which have larger dimensions and therefore masses and which, for example, allow up to 48 tabloid pages to be printed per printing group.

The lowering movements of the cylinders could bring about significant impacts, in particular on the stops, and lead to occurrences of damage.

SUMMARY OF THE INVENTION

An object of the invention is to overcome this problem by providing a printing unit which allows the risks of damage to be limited when moving between the various configurations of the unit, even with cylinders having large dimensions.

The present invention provides a printing unit wherein the support mechanism includes at least a first system for returning the mass of at least a first cylinder of the first printing group towards a first cylinder of the second printing group and vice-versa so that the first cylinders form mutual counterweights when the printing unit moves between the throw-on and throw-off configurations thereof.

According to specific embodiments, the unit may include one or more of the following features, taken in isolation or according to all technically possible combinations:

the first return system includes a sub-system which is arranged at a first side of the printing assemblies and a second sub-system which is arranged at another side of the printing assemblies, the two sub-systems being connected by means of a shaft which extends parallel with the plate cylinders and blanket cylinders;

the first return system includes a first lever which is articulated to the frame at an articulation point and which is connected by means of first connection points to the first cylinders of the printing assemblies;

the articulation point is arranged between the connection points;

the connection points are connected to the first cylinders by means of first connection rods;

the unit also has a plate-changing configuration in which the blanket cylinders are mutually spaced-apart and pressed against the plate cylinders of their respective printing assemblies, and the first cylinders of the printing assemblies form mutual counterweights when the printing unit moves between the plate-changing configuration and the throw-on configuration or throw-off configuration thereof;

the first cylinders are the blanket cylinders;

the support mechanism also comprises a second system for returning the mass of at least a second cylinder of the first printing group towards a second cylinder of the second printing group and vice-versa, so that the second cylinders form mutual counterweights when the printing unit moves between its configurations;

the second return system includes a second lever which is articulated to the frame at an articulation point and which is connected by means of second connection points to the second cylinders of the printing assemblies, the articulation point of the second lever is arranged between the second connection points, the second connection points are connected to the second cylinders by means of second connection rods, the first lever and the first connection rods form first toggle joints which are in aligned positions when the unit is in a plate-changing configuration and are in offset positions when the press is in the throw-on and throw-off configurations, and the second lever and the second connection rods form second toggle joints which are in aligned positions when the press is in the throw-off configuration and in offset positions when the press is in the throw-on configuration and in the plate-changing configuration;

the first return system and the second return system are formed by the same return system; and the support mechanism includes receiving arms which are articulated to the frame in order to be able to pivot about axes which are parallel with the plate and blanket cylinders, and the ends of the cylinders pivot in the receiving arms.

The invention also relates to a printing press which includes at least one printing unit.

BRIEF DESCRIPTION OF THE DRAWINGS

The invention will be better understood from a reading of the following description, given purely by way of example and with reference to the appended drawings, in which.

DETAILED DESCRIPTION OF A PREFERRED EMBODIMENT

Figure 1:
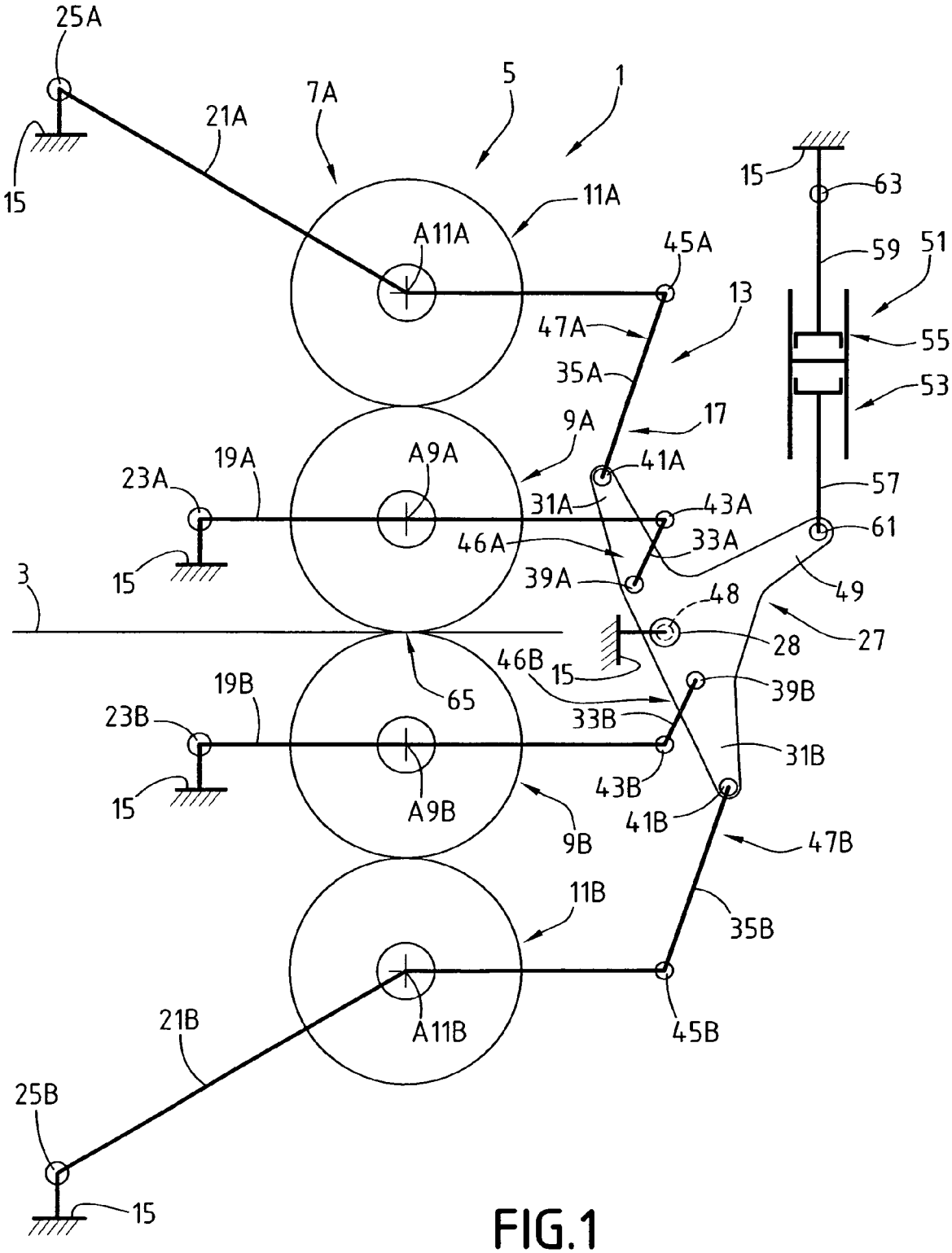
FIG. 1 is a schematic side view of a printing unit of a rotary band press according to a first embodiment of the invention, the unit being in the throw-on configuration.

FIG. 1 illustrates a rotary offset press 1 which is intended to print a web 3 of paper. In the example illustrated, the passage of the web 3 is horizontal, that is to say, it will move horizontally, for example, from left to right, under the action of various conventional items of equipment of the press 1 which are not illustrated.

FIG. 1 illustrates a single printing unit 5 of the press 1. Typically, the press 1 will include a plurality of printing units which are arranged one behind the other along the path of the web 3, for example, eight printing units which are intended, for example, to print in black, cyan, yellow and magenta. All the printing units of the press 1, or only some, may have the structure of the unit 5 which will be described below.

The unit 5 is a dual printing unit which includes two printing assemblies 7A and 7B which are arranged one above the other.

The upper printing group 7A and the lower printing group 7B have similar structures so that only that of the group 7A will be described below and the differences in structure between the assemblies 7A and 7B will be indicated. The reference numerals used for the assemblies 7A and 7B will be distinguished by the use of suffixes A and B.

The printing group 7A principally includes a blanket cylinder 9A, a plate cylinder 11A, and an inking system and a moistening system.

The printing unit 5 also includes a throw-off mechanism 13 for supporting and moving the cylinders 9A, 9B, 11A and 11B. This mechanism 13 and the printing groups 7A, 7B are carried by the frame 15 of the printing unit 5. Only parts of the frame 15 are illustrated in FIG. 1. Conventionally, the frame 15 includes two lateral walls between which the cylinders 9A, 9B, 11A and 11B extend.

The support mechanism 13 includes two assemblies 17, each of which is arranged at one side of the printing unit 5 and which is carried by the corresponding lateral wall of the frame 15. The two assemblies 17 have structures which are similar and only that of the assembly 17 which can be seen in FIG. 1 will be described below.

The assembly 17 includes receiving arms for the blanket cylinders 9A and 9B, designated 19A and 19B respectively, and receiving arms for the plate cylinders 11A and 11B, designated 21A and 21B respectively. The arms 19A, 19B, 21A, 21B are articulated to the frame 15 at points 23A, 23B, 25A and 25B which allow them to pivot relative to the frame 15 parallel with the axes A9A, A9B, A11A and A11B of the cylinders 9A, 9B, 11A and 11B. In the example illustrated, the articulation points 23A, 23B, 25A and 25B are located at the left-hand ends of the arms 19A, 19B, 21A and 21B.

The ends of the cylinders 9A, 9B, 11A and 11B located at the side of the assembly 17 are received so as to rotate in the arms 19A, 19B, 21A and 21B, respectively. Each cylinder can thus rotate about its respective axis A9A, A9B, A11A and A11B. This rotation of the cylinders is carried out under the action of a drive motor which can be common to the whole of the printing unit 5 or, for example, under the action of a separate motor for each printing group 7A and 7B, or under the action of four separate driving motors which each drive a cylinder.

The assembly 17 further includes a lever 27 for returning the masses of the cylinders 9A and 11A to the cylinders 9B and 11B and vice-versa.

This lever 27 is articulated to the frame 15 at a point 28 in order to be able to pivot about an axis parallel with the axes A9A, A9B, A11A and A11B of the cylinders. The lever 27 includes two arms 31A and 31B for connection to the arms 19A, 19B, 21A and 21B.

More precisely, the arms 31A and 31B are connected to the arms 19A, 19B, 21A, 21B by means of connection rods 33A, 33B, 35A and 35B, the connection rods are articulated to the lever 27 at points 39A, 39B, 41A and 41B and to the arms 19A, 19B, 21A and 21B at points 43A, 43B, 45A and 45B.

In the example illustrated, the articulation points 43A, 43B, 45A and 45B are located at the right-hand ends of the arms 19A, 19B, 21A and 21B. The point 28 is located between the points 39A and 39B at one side and the points 41A and 41B at the other side. The straight lines which extend through the points 28, 39A and 39B and through the points 28, 41A and 41B respectively are inclined relative to each other. The arms 31A and 31B form, with the connection rods 33A, 33B, 35A and 35B, toggle joints 46A, 46B, 47A and 47B.

The levers 27 of each of the assemblies 17 of the mechanism 13 are connected to each other by means of a synchronisation shaft 48 which extends parallel with the axes A9A, A9B, A11A and A11B of the cylinders, between the lateral walls of the frame 15 in order to fixedly join the two levers 27 in terms of rotation.

One of the two levers 27, in this instance that illustrated in FIG. 1, further includes a third manoeuvring arm 49 on which a system 51 for controlling the movement of the levers 27 acts.

In the example illustrated, this system 51 includes two pneumatic jacks 53 and 55 which are mounted in tandem.

The respective rods 57 and 59 thereof are thus opposed and one is connected to the manoeuvring arm 49 by means of an articulation point 61, and the other to the frame 15 by means of an articulation point 63.

The movement of the rods 57 and 59 of the pneumatic jacks 53 and 55 from the extended positions to the retracted positions thereof allows the printing unit 5 to have three different configurations which will be described below.

The first configuration is illustrated in FIG. 1. It is the throw-on configuration. The blanket cylinders 9A and 9B are pressed against each other and against their respective plate cylinders 11A and 11B.

The rods 57 and 59 of the jacks 53 and 55 are in retracted positions. The toggle joints 46A, 46B, 47A and 47B are in offset positions.

The unit 5 can then print the web of paper 3 which moves between the cylinders 11A and 11B in the region of a pinching point 65 ("nip").

Conventionally, during the printing operation, the cylinders 9A, 9B, 11A and 11B are driven in rotation about their respective centre axes.

The plate(s) carried by the plate cylinders 11A and 11B are moistened then inked by the inking and moistening systems.

These plates transfer the ink from the printing regions thereof to the blankets carried by the cylinders 9A and 9B which transfer the ink to the web 3 which is thus printed on both sides thereof.

Figure 2:
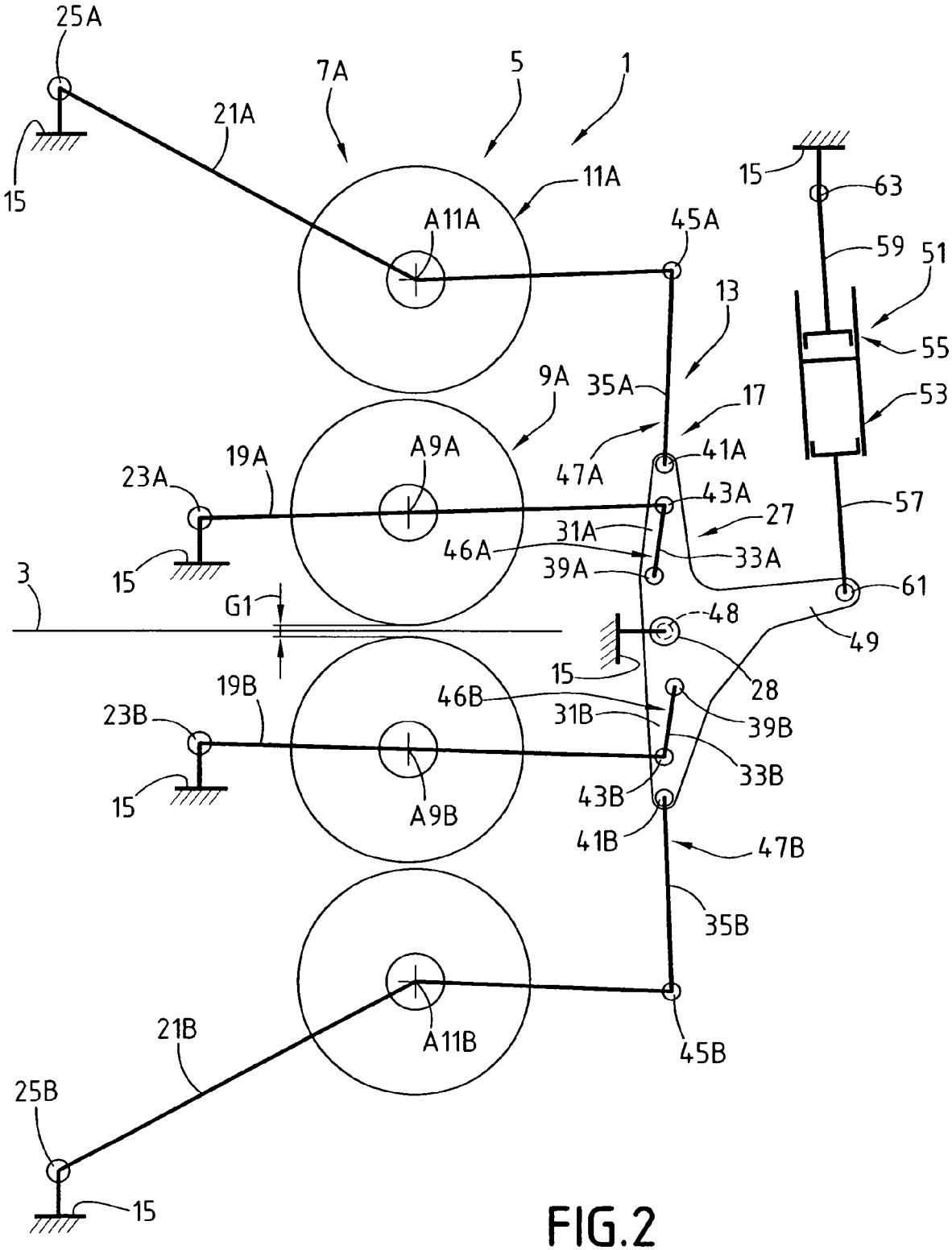
FIGS. 2 and 3 are views similar to FIG. 1, illustrating the unit in the throw-off configuration and in the plate-changing configuration, respectively.

In order to move into the second configuration illustrated in FIG. 2, the rod 57 of the jack 53 moves into an extended position, thus bringing about the rotation of the lever 27 about the articulation point 28 in a clockwise direction in FIGS. 1 and 2.

The toggle joints 47A and 47B, formed by the arms 31A and 31B and the connection rods 35A and 35B then move into aligned positions, thus bringing about upward pivoting of the arm 21A about the articulation point 25A, and downward pivoting of the arm 21B about the articulation point 25B. The plate cylinders 11A and 11B have then been raised towards their highest positions.

The rotation of the lever 27 has also brought about a slight deflection of the toggle joints 46A and 46B, formed by the connection rods 33A and 33B and the arms 31A and 31B. The arm 19A has thus pivoted upwards about the articulation point 23A and the lever 19B has pivoted downwards about the articulation point 23B. It should be noted that these toggle joints 46A and 46B are still in offset positions.

The blanket cylinders 9A and 9B are spaced apart from each other and from the plate cylinders 11A and 11B.

The space between the blanket cylinder 9A and the blanket cylinder 9B allows the web 3 to pass freely between them without touching them in order to be printed by another unit of the press, Typically, the height G1 of this space is approximately 30 mm.

This second configuration can be used, for example, to change the blankets carried by the cylinders 9A and 9B.

Figure 3:
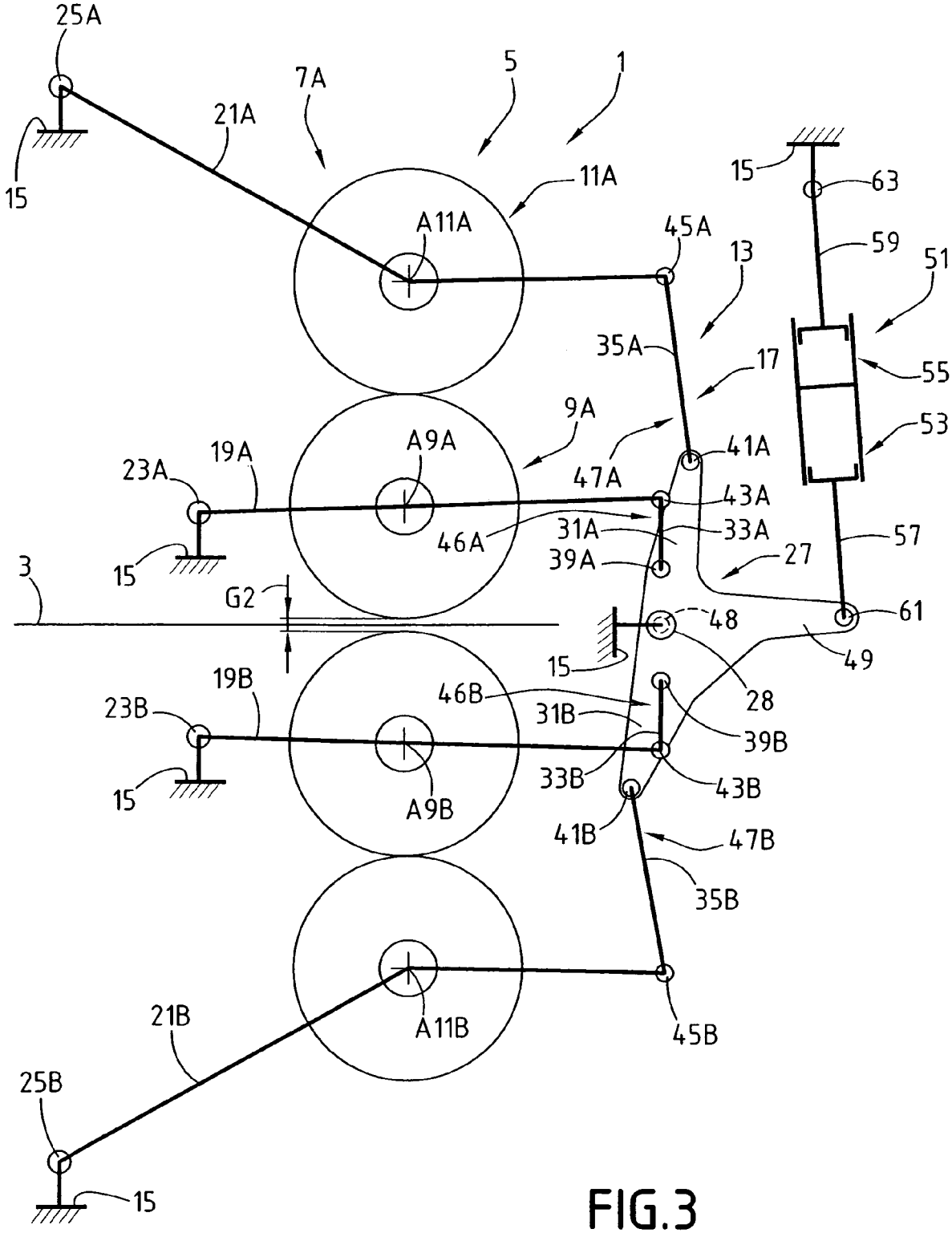

In order to move into the third configuration, illustrated in FIG. 3, the rod 59 of the second jack 55 moves into the extended position thereof, again causing the lever 27 to rotate about the articulation point 28 in the clockwise direction in FIGS. 1 to 3. The toggle joints 47A and 47B then move into offset positions, thus bringing about a slight downward pivoting of the arm 21A about the articulation point 25A, and a slight upward pivoting of the arm 21B about the articulation point 25B. The plate cylinder 11A therefore moves downwards slightly and the plate cylinder 11B rises slightly.

The toggle joints 46A and 46B themselves move into aligned positions, thus bringing about a slight upward pivoting of the arm 19A about the articulation point 23A, and a slight downward pivoting of the arm 19B about the articulation point 23B. The blanket cylinder 9A thus rises to reach its highest position and thus comes into contact with the plate cylinder 11A. The lower blanket cylinder 9B moves down towards its lowest position and comes into contact with the plate cylinder 11B.

In this third configuration, referred to as the plate-changing configuration, there is still a space between the blanket cylinders 9A and 9B. The height G2 thereof is typically approximately 34 mm which allows the web 3 to pass freely between the cylinders 9A and 9B in order to be printed by another unit of the press.

This third configuration, in which the unit 5 is non-operational, allows, for example, the plates to be removed or positioned on the plate cylinders 11A and 11B, for example, using a manual, automated or semi-automated method.

The movement from the third to the second then to the first configuration is carried out in the reverse order to that described above.

When the press 5 moves between its various configurations, the weight of the plate cylinder 11A is returned by the lever 27 towards the plate cylinder 11B and the weight of the blanket cylinder 9A is returned towards the blanket cylinder 9B, and vice-versa.

In this manner, the blanket cylinders 9A and 9B at one side and the plate cylinders 11A and 11B at the other side act as mutual counterweights. The risks of damage owing to impacts when moving between the various configurations therefore may be reduced, even when the cylinders have large dimensions, for example, in order to allow printing of 80 or even 96 tabloid pages by the printing unit 5, that is to say, 40 or 48 pages per printing group.

Furthermore, the lowering and raising movements of the cylinders 9A, 9B, 11A and 11B may be carried out smoothly and substantially at the same speed.

Furthermore, the positions occupied by the cylinders may be stable. This is in particular the case for the second and third configurations. The safety problems relating to a malfunction of the control system 51 thus may be reduced to a greater extent than in the presses of the prior art wherein such configurations were not stable and the cylinders were retained in these configurations by means of the control system.

Furthermore, the forces which must be produced by the control system 51 in order to ensure the movement of the cylinders may be in particular reduced since the masses of the various cylinders compensate for each other. The control system 51 may include, in particular for these reasons, a greatly reduced number of jacks and can therefore be very economical.

Owing to the connection shaft 48, the movements of the two sides of the frame 25 are synchronised so that the levels of torsion which may occur may be reduced.

In a variant, it can be seen that a connection shaft 48 of this type can be dispensed with, control systems 51 being present at each side of the frame 15 in order to each drive a lever 27.

In a variant, it also may be possible to replace each lever 27 with two levers. A first lever is connected to the connection rods 33A and 33B and returns the masses between the blanket cylinders 9A and 9B. A second lever is connected to the connection rods 35A and 35B and returns the masses between the plate cylinders 11A and 11B.

More generally, it may be possible to bring about the compensation of the masses between only two of the cylinders, for example, only between the blanket cylinders 9A and 9B.

Also more generally, the principles described above may apply to printing units 5 having a high level of pagination, that is to say, having printing cylinders with large dimensions, but also to printing units having a lower level of pagination.

In the same manner, the movement of the web 3 of paper is not necessarily horizontal, but may be, for example, vertical.

Furthermore, it may be possible to use levers 27 in which the articulation point 28 is not arranged between the articulation points 39A and 39B at one side and 41A and 41B at the other side.

The return lever 27 may also be replaced by any other system, for example, a system of cables and pulleys.

The invention claimed is:

1. A unit for printing a web of paper comprising:

a frame;

at least a first and a second printing group, the first printing group including a first blanket cylinder and a first plate cylinder, the second printing group including a second blanket cylinder and a second plate cylinder; and a throw-off mechanism supporting and moving the first and second printing groups into a first position and a second position, the first position being a throw-on configuration, wherein the first blanket cylinder is pressed against the second blanket cylinder, the first plate cylinder is pressed against the first blanket cylinder and the second plate cylinder is pressed against the second blanket cylinder, the second position being a throw-off configuration wherein the first blanket cylinder is spaced apart from the second blanket cylinder, the first plate cylinder is spaced apart from the first blanket cylinder and the second plate cylinder is spaced apart from the second blanket cylinder, the throw-off mechanism returning a mass of at least one of the first plate cylinder and the first blanket cylinder towards at least one of the second plate cylinder and the second blanket cylinder and vice-versa so that the masses form mutual counterweights between the first and second positions.

2. The printing unit as recited in claim 1 wherein the throw-off mechanism includes a first return system including a first sub-system arranged at a side of the printing unit and a second sub-system arranged at another side of the printing unit, the first and second sub-systems being connected by a shaft, the shaft being parallel to the first and second plate and blanket cylinders.

3. The printing unit as recited in claim 2 wherein the first return system includes a first lever articulated to the frame at a first articulation point and connected by first connection points to the at least one of the first plate and first blanket cylinders, and the at least one of the second plate and second blanket cylinders.

4. The printing unit as recited in claim 3 wherein the first articulation point is arranged between the first connection points.

5. The printing unit as recited in 4 wherein the first connection points are connected to the at least one of the first plate and first blanket cylinders, and the at least one of the second plate and second blanket cylinders by first connection rods.

6. The printing unit as recited in claim 1 wherein the throw-off mechanism moves the first and second printing groups to a plate-changing configuration wherein the first and second blanket cylinders are spaced-apart and pressed against the first and second plate cylinders, respectively, and wherein the at least one of the first plate and first blanket cylinders and the at least one of the second plate and second blanket cylinders form mutual counterweights when the printing unit moves between the plate-changing configuration and at least one of the throw-on configuration and throw-off configuration.

7. The printing unit as recited in claim 1 wherein the at least one of the first plate and first blanket cylinders is the first blanket cylinder.

8. The printing unit as recited in claim 3 wherein the throw-off mechanism includes a second return system for returning a mass of at least one of the first plate cylinder and first blanket cylinder towards at least one of the second plate cylinder and second blanket cylinder and vice-versa so that the masses form mutual counterweights between the first and second positions.

9. The printing unit as recited in claim 8 wherein the second return system includes a second lever articulated to the frame at a second articulation point and connected by second connection points to the at least one of the first plate cylinder and first blanket cylinder and the at least one of the second plate cylinder and second blanket cylinder;

the second articulation point of the second lever being arranged between the second connection points, the second connection points being connected to the at least one of the first plate and first blanket cylinders, and the at least one of the second plate and second blanket cylinders by second connection rods, a first lever and first connection rods forming first toggle joints, the first toggle joints being in aligned positions when the printing unit is in a plate-changing configuration and being in offset positions when the printing unit is in the first or second position, the second lever and the second connection rods forming second toggle joints, the second joints being in aligned positions when the printing unit is in the second position and being in offset positions when the printing unit is in the first position and in the plate-changing configuration.

10. The printing unit as recited in claim 1 wherein the throw-off mechanism includes receiving arms articulated to the frame and pivotable about axes parallel with the first and second plate and blanket cylinders and ends of the first and second plate and blanket cylinders pivot in the receiving arms.

11. A printing press comprising at least one printing unit as recited in claim 1.

* * * * *